US010806197B2

(12) United States Patent
Spencer et al.

(10) Patent No.: US 10,806,197 B2
(45) Date of Patent: Oct. 20, 2020

(54) OVEN MITT AND POT HOLDER DEVICES WITH INTEGRATED FIRE EXTINGUISHING BLANKET

(71) Applicants: Emma Spencer, Bothell, WA (US); Scott Johnson, Bothell, WA (US)

(72) Inventors: Emma Spencer, Bothell, WA (US); Scott Johnson, Bothell, WA (US)

( * ) Notice: Subject to any disclaimer, the term of this patent is extended or adjusted under 35 U.S.C. 154(b) by 0 days.

(21) Appl. No.: 15/220,356

(22) Filed: Jul. 26, 2016

(65) Prior Publication Data

US 2018/0027904 A1 Feb. 1, 2018

(51) Int. Cl.
*A41D 19/015* (2006.01)
*A41D 19/01* (2006.01)
*A41D 31/08* (2019.01)

(52) U.S. Cl.
CPC ..... *A41D 19/01529* (2013.01); *A41D 19/01* (2013.01); *A41D 31/085* (2019.02)

(58) Field of Classification Search
CPC ..... A41D 19/00; A41D 19/01; A41D 19/015; A41D 19/01529; A41D 13/081; A41D 31/0027
USPC ..... 2/16, 158, 159, 20
See application file for complete search history.

(56) References Cited

U.S. PATENT DOCUMENTS 1,006,510 A * 10/1911 Tabor ..... A41D 19/01 2/158
1,302,038 A * 4/1919 Hayes ..... A41D 13/08 2/170
1,972,197 A * 9/1934 McCann ..... A41D 13/081 2/20
2,304,137 A * 12/1942 Peakes ..... A41D 19/015 2/164
2,306,062 A * 12/1942 Katz ..... A47J 45/10 2/20
2,375,129 A * 5/1945 Norton ..... A47J 45/10 16/435
2,391,263 A * 12/1945 Morton ..... A41D 19/01 2/158
2,499,601 A * 3/1950 Merkin ..... A47G 19/20 2/158

(Continued)

OTHER PUBLICATIONS

Different Ways to Extinguish Different Fires | Buffalo Grove, IL—Official Website. Jul. 8, 2015. Accessed May 9, 2018. https://www.vbg.org/531/Different-Ways-To-Extinguish-Different-F.*

(Continued)

*Primary Examiner* — Anne M Kozak
(74) *Attorney, Agent, or Firm* — Lewis Roca Rothgerber Christie LLP

(57) ABSTRACT

A device for handling hot objects and extinguishing a fire and a method of using the same are provided. A device for handling hot objects and extinguishing a fire includes: a first portion comprising an inner surface portion defining a pocket configured to receive a hand of a user therein; and a second portion configured to extinguish a fire by smothering, the second portion being configurable between a first configuration in which the second portion at least partially covers the first portion and has a first exposed surface area and a second configuration in which the second portion has a second exposed surface area greater than the first exposed surface area.

5 Claims, 12 Drawing Sheets

(56) References Cited

U.S. PATENT DOCUMENTS 2,570,848 A * 10/1951 Ozenberger ..... A41D 13/04 2/20
2,641,793 A * 6/1953 Wilm ..... A47J 45/10 15/220.2
2,810,131 A * 10/1957 Kogut ..... A41D 19/01 2/158
2,889,556 A * 6/1959 Mehler ..... A41D 19/01 2/158
2,905,946 A * 9/1959 Goldsmith ..... A41D 19/01 16/435
3,581,447 A * 6/1971 Falivene ..... C11D 17/049 451/532
4,071,921 A * 2/1978 Jury ..... A41D 13/082 15/227
4,085,464 A * 4/1978 Simonoff ..... A41D 19/01 2/158
D268,222 S * 3/1983 Chen ..... 2/158
4,411,026 A * 10/1983 Secter ..... A41D 19/00 2/158
4,624,320 A * 11/1986 Romaine ..... A62C 8/06 169/50
4,959,881 A * 10/1990 Murray ..... A47L 13/18 15/104.94
5,343,566 A * 9/1994 Solheim ..... A41D 19/01 2/158
5,358,470 A * 10/1994 Johnson ..... A61F 5/3746 128/DIG. 15
5,490,567 A * 2/1996 Speer ..... A62C 8/06 169/50
5,560,491 A * 10/1996 Romaniuk ..... A62B 3/00 206/223
5,609,431 A * 3/1997 Carroll ..... A41D 19/01 401/200
5,634,212 A * 6/1997 Gilbert ..... A41D 19/01 2/158
5,878,438 A * 3/1999 Ragsdale ..... A41D 19/01 2/158
5,878,439 A * 3/1999 Waters, Jr. ..... A41D 13/08 15/227
5,924,130 A * 7/1999 Fragomeli ..... A41D 13/08 2/16
6,010,431 A * 1/2000 Taylor ..... A61F 5/0118 128/898
6,298,488 B1 * 10/2001 Duncan ..... A41D 19/01 2/158
6,305,023 B1 * 10/2001 Barkes ..... A41D 13/081 2/158
6,637,035 B1 * 10/2003 Brinkmann ..... A41D 19/0068 15/227
6,951,594 B2 * 10/2005 Tweel ..... A47G 23/0303 156/230
6,983,805 B2 * 1/2006 Chattaway ..... A62C 8/06 169/36
7,380,288 B1 * 6/2008 Duncan ..... A41D 19/01529 2/161.6
7,383,590 B1 * 6/2008 Duncan ..... A41D 13/08 2/158
7,526,814 B2 * 5/2009 Silver ..... A41D 19/01529 2/158
9,731,154 B2 * 8/2017 Hutton ..... A62C 3/0257
2002/0174478 A1 * 11/2002 Litke ..... A41D 19/0051 2/161.4
2004/0148680 A1 * 8/2004 Lehmann ..... A41D 13/043 2/159
2004/0226075 A1 * 11/2004 Marchal ..... A41D 19/0044 2/160
2005/0108802 A1 * 5/2005 Burnett ..... A41D 13/087 2/16
2005/0114983 A1 * 6/2005 Demay ..... A41D 19/01529 2/160
2005/0278827 A1 * 12/2005 Price ..... A41D 19/01529 2/158
2006/0080757 A1 * 4/2006 Beyda ..... A41D 19/01529 2/164
2008/0271615 A1 * 11/2008 Viveiros ..... A41D 19/0051 101/34
2008/0282439 A1 * 11/2008 Sarkies ..... A41D 19/01 2/20
2008/0316868 A1 * 12/2008 Sardis ..... A41D 19/01594 368/10
2009/0077704 A1 * 3/2009 Duncan ..... A41D 19/01 2/16
2009/0094722 A1 * 4/2009 Alden ..... A41D 19/01529 2/20
2009/0100562 A1 * 4/2009 Liang ..... A41D 19/01 2/20
2009/0113591 A1 * 5/2009 Deutsch ..... A41D 13/08 2/16
2009/0293166 A1 * 12/2009 Shayne ..... G06Q 30/02 2/20
2011/0145967 A1 * 6/2011 Hull ..... A41D 19/0065 2/16
2014/0245517 A1 * 9/2014 Henry ..... A41D 19/01 2/16
2014/0352030 A1 * 12/2014 Holland ..... A41D 19/0024 2/160
2015/0052656 A1 * 2/2015 Poznick ..... A41D 19/0024 2/16
2015/0272399 A1 * 10/2015 Campanelli ..... A47K 10/02 15/209.1

OTHER PUBLICATIONS

Arm Lengths—How to Get the Proper Fit. Grainger Web, "KnowHow(R)." Retrieved Dec. 9, 2019. https://www.grainger.com/know-how/safety/ppe-in-the-workplace/ppe-management/kh-safety-glove-size-chart-qt-306.*

Guinness hails Franklin Man's 31-inch biceps. Boston Globe Web. Dated Oct. 2, 2012. Retrieved Dec. 9, 2019. https://www.bostonglobe.com/metro/2012/10/01/guiness-recognizes-inch-biceps/W17AhnTvMPzFeHx4Vacf5O/story.html.*

* cited by examiner

OVEN MITT AND POT HOLDER DEVICES WITH INTEGRATED FIRE EXTINGUISHING BLANKET

FIELD

Aspects of embodiments of the present invention relate to oven mitt and pot holder devices with an integrated fire extinguishing blanket, and a method of using the same.

BACKGROUND

According to studies of the National Fire Protection Association, as of 2013, 2,755 Americans died in house fires, and, of those house fires, about fifty percent started in the kitchen. Too often, a house fire may start in a kitchen, and a person may not have a conventional fire extinguisher nearby and ready to extinguish the fire. Additionally, most houses do not have fire sprinklers to extinguish a kitchen fire. Furthermore, many people do not know how to properly extinguish a kitchen fire, such as a grease fire or a cooking oil fire.

SUMMARY

According to an aspect of embodiments of the present invention, a device configured for everyday use as an oven mitt or pot holder also is useable as a fire extinguishing blanket for quickly and safely smothering small to medium-sized kitchen fires. The device is quickly and easily locatable and deployable to extinguish a fire before the fire gets too large to be safely extinguished by a resident of the home, restaurant, recreational vehicle, or other location. According to an aspect of embodiments of the present invention, a device for handling hot objects and extinguishing a fire by smothering and a method of using the same are provided.

According to another aspect of embodiments of the present invention, a device includes a first portion (e.g., a kitchen oven mitt or pot holder) with an integrated second portion (e.g., a fire extinguishing blanket) that is reconfigurable between a closed (e.g., folded and/or wrapped) configuration in which the device may be conveniently used to handle objects in the kitchen, and an opened (e.g., unfolded and/or unwrapped) configuration having a greater exposed surface area in which the device may be used to extinguish a fire by smothering.

According to another aspect of embodiments of the present invention, the device for handling hot objects and extinguishing a fire by smothering is configured to suffocate the fire by removing oxygen, and does not contain metal or glue which could worsen the fire.

According to another aspect of embodiments of the present invention, the device for handling hot objects and extinguishing a fire includes fire safety tips visibly arranged on the device, such that the device may function as an informational safety tool.

According to one embodiment of the present invention, a device for handling hot objects and extinguishing a fire includes: a first portion comprising an inner surface portion defining a pocket configured to receive a hand of a user therein; and a second portion configured to extinguish a fire by smothering, the second portion being configurable between a first configuration in which the second portion at least partially covers the first portion and has a first exposed surface area and a second configuration in which the second portion has a second exposed surface area greater than the first exposed surface area.

In one embodiment, the second portion is at least one of foldable or wrappable around the first portion to be in the first configuration.

The second portion may be made of wool and/or other suitable materials that are fire and/or heat resistant for use in a fire blanket.

In one embodiment, the second portion is made of a fire-resistant material, and the inner surface portion is made of a second material different from the fire-resistant material of the second portion.

In one embodiment, the first portion further includes an outer surface portion made of a fire-resistant material, and the inner surface portion is made of a second material different from the fire-resistant material of the outer surface portion. The outer surface portion may be made of wool and/or other suitable materials that are fire and/or heat resistant for use in a fire blanket. In one embodiment, the outer surface portion and the second portion are made of a same material.

In one embodiment, the second portion is integrally connected with the first portion.

In one embodiment, the pocket has an opening at a first end of the first portion, and the second portion is wrappable around the first portion at the first end to be in the first configuration.

In one embodiment, the first portion further defines another pocket, and the second portion is receivable in the other pocket to be in the first configuration.

In one embodiment, the device further includes a maintaining device configured to maintain the second portion in the first configuration. In one embodiment, the maintaining device includes a hook-and-loop type fastener. In one embodiment, the maintaining device includes one or more ties.

In one embodiment, the device further includes fire safety instructions arranged on the device, the fire safety instructions being visible when the second portion is in each of the first configuration and the second configuration.

The second portion, in the second configuration, may have a length of about 24 inches to about 36 inches and a width of about 24 inches to about 36 inches.

In one embodiment, the second portion is in accordance with ASTM F1989-05.

In one embodiment, the device further includes one or more handles configured to be held by a user to place the device over a fire.

According to another embodiment of the present invention, a method of using a device for handling hot objects and including a first portion defining a pocket, and a second portion configured to extinguish a fire by smothering, the second portion being configurable between a first configuration in which the second portion at least partially covers the first portion and has a first exposed surface area and a second configuration in which the second portion has a second exposed surface area greater than the first exposed surface area, includes at least one of handling a hot object or extinguishing a fire using the device.

In one embodiment, the method further includes inserting a hand into the pocket of the first portion.

In one embodiment, the method further includes reconfiguring the second portion from the first configuration to the second configuration. In one embodiment, reconfiguring the second portion from the first configuration to the second configuration includes at least one of unwrapping the second portion from an outside of the first portion or unfolding the second portion.

In one embodiment, the method further includes covering a fire with the second portion, the second portion being in the second configuration.

In one embodiment, the first portion further defines another pocket, and the method further includes removing the second portion from the other pocket.

Additional aspects and/or advantages of embodiments of the present invention are set forth in the following description and accompanying drawings, or may be obvious in view thereof to those skilled in the art.

BRIEF DESCRIPTION OF THE DRAWINGS

The above and other features and advantages will become more apparent to those of ordinary skill in the art by describing in detail some exemplary embodiments of the present invention with reference to the attached drawings, in which.

DETAILED DESCRIPTION

Some exemplary embodiments will now be described more fully hereinafter with reference to the accompanying drawings; however, embodiments of the present invention may be embodied in different forms and should not be construed as limited to the exemplary embodiments illustrated and set forth herein. Rather, these exemplary embodiments are provided by way of example for understanding of the invention and to convey the scope of the invention to those skilled in the art.

Figure 1:
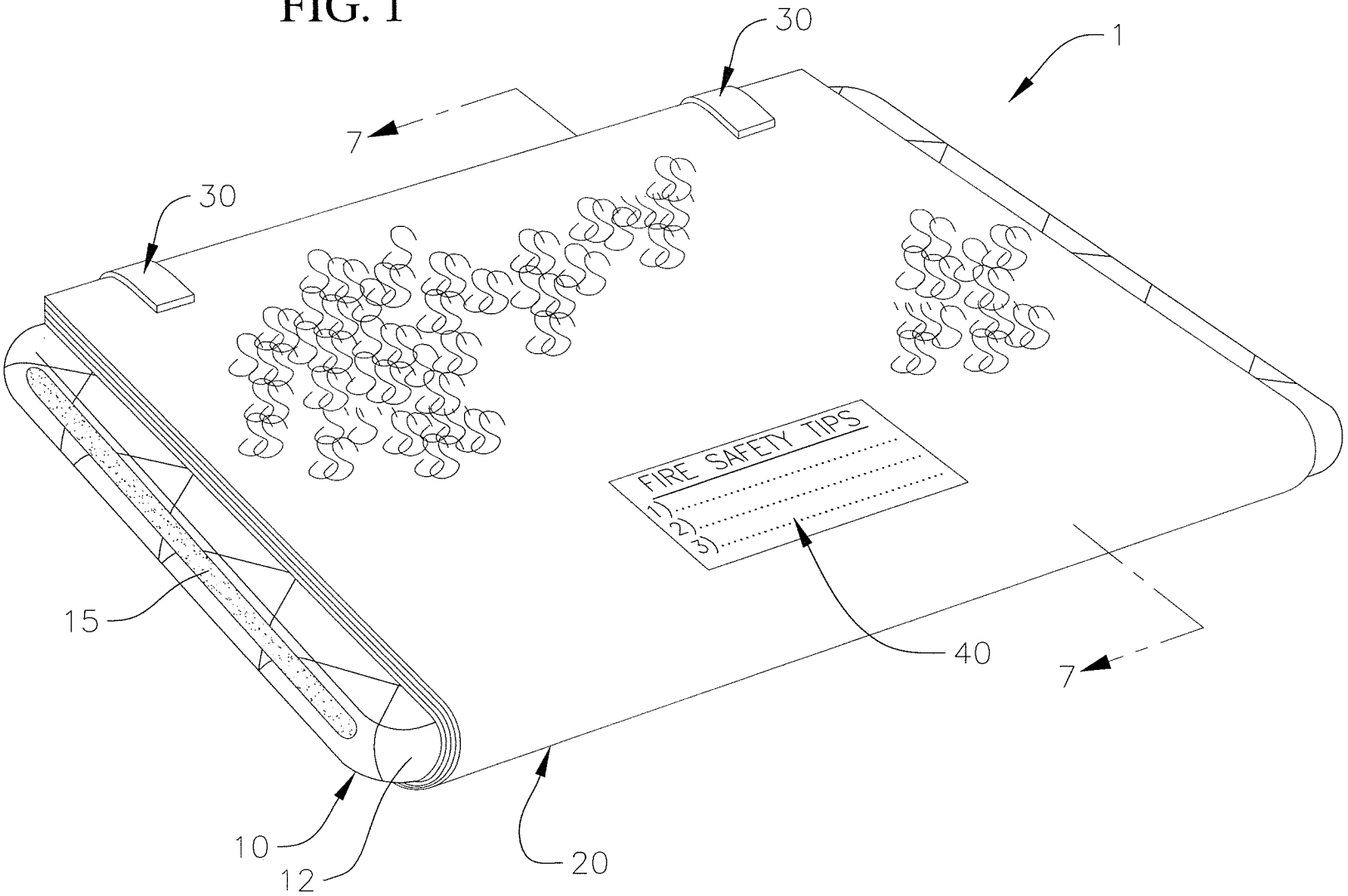
FIG. 1 is a perspective view of a device for handling hot objects and extinguishing a fire, according to an embodiment of the present invention.

With reference to FIG. 1, a device 1 for handling hot objects and extinguishing a fire, according to an embodiment of the present invention, is configured as an oven mitt and/or pot holder with integrated fire extinguishing blanket. As used herein, the terms "oven mitt," "mitt," and "pot holder" refer to devices for handling hot objects, such as kitchen pots, dishes, etc., and may be used interchangeably. According to an embodiment of the present invention, the device 1 includes a first portion, or mitt portion, 10, and a second portion, or blanket portion, 20 integrated with the mitt portion 10. The blanket portion 20 is configurable between a first configuration (see FIG. 1), or closed configuration, in which the blanket portion 20 at least partially covers the mitt portion 10 and has a first exposed surface area and a second configuration (see FIG. 3), or opened configuration, in which the blanket portion 20 has a second exposed surface area greater than the first exposed surface area. As such, when the blanket portion 20 is in the closed configuration, the device 1 may be conveniently used to handle hot objects. Furthermore, when the blanket portion 20 is in the opened configuration, the device 1 may be used to extinguish a fire by smothering.

Figure 7:
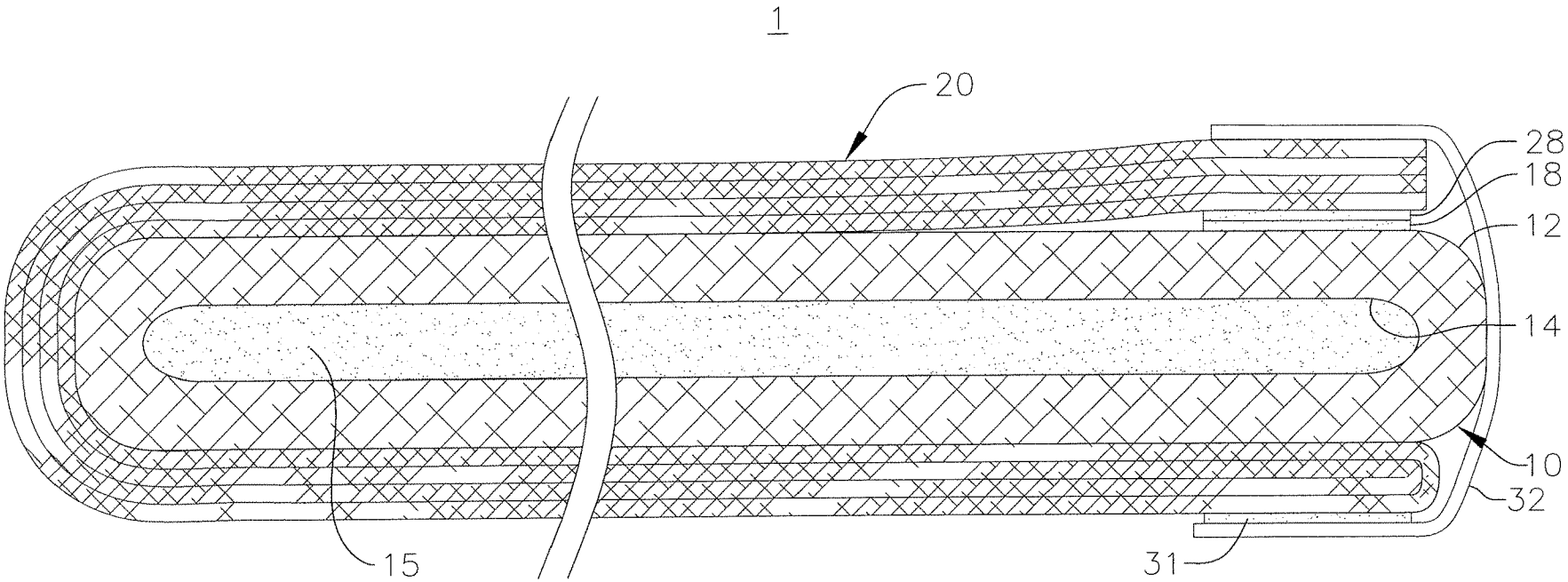
FIG. 7 is a cross-sectional view of the device of FIG. 1, taken along the line 7-7 of FIG. 1.

With reference to FIGS. 1 and 7, according to an embodiment, the mitt portion 10 has an outer surface portion 12, and an inner surface portion 14 defining a pocket 15 into which a user may insert a hand to protect the hand when handling hot objects. In an embodiment, the inner surface portion 14 is made of a material which is comfortable against the hand, such as cotton, polyester, or neoprene, for example. The outer surface portion 12, in one embodiment, is made of a material different from the material of the inner surface portion 14. The outer surface portion 12, in one embodiment, is made of a fire-resistant material, such as wool and/or other suitable materials that are fire and/or heat resistant for use in a fire blanket, such as materials that are compliant with ASTM F1989-05, titled "Standard Specification for Cooking Fire Suppression Blankets," for example. Further, in one embodiment, the outer surface portion 12 may be made of a same material as that of the blanket portion 20.

Figure 3:
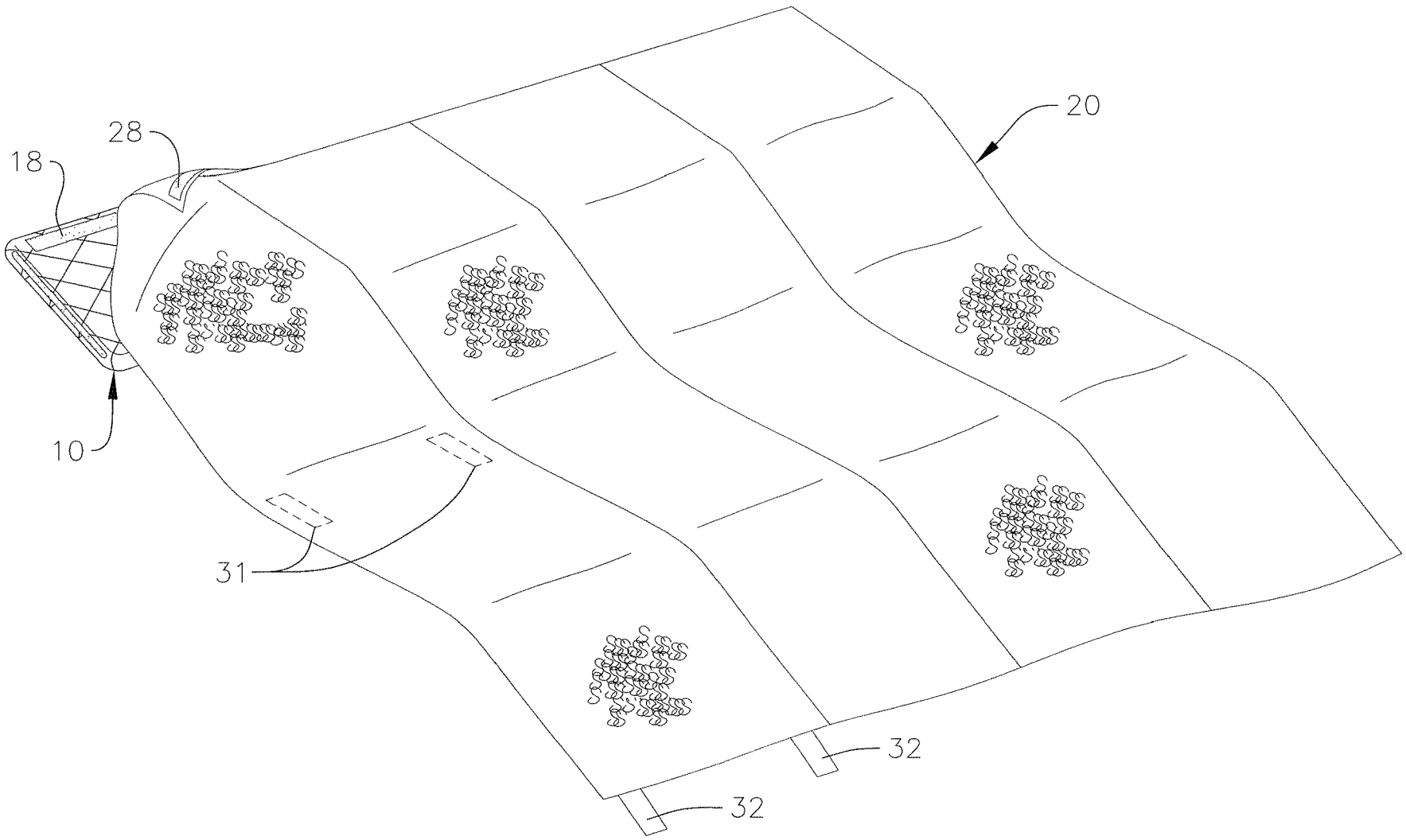
FIG. 3 is a perspective view of the device of FIG. 1, shown in an opened configuration.
Figure 4:
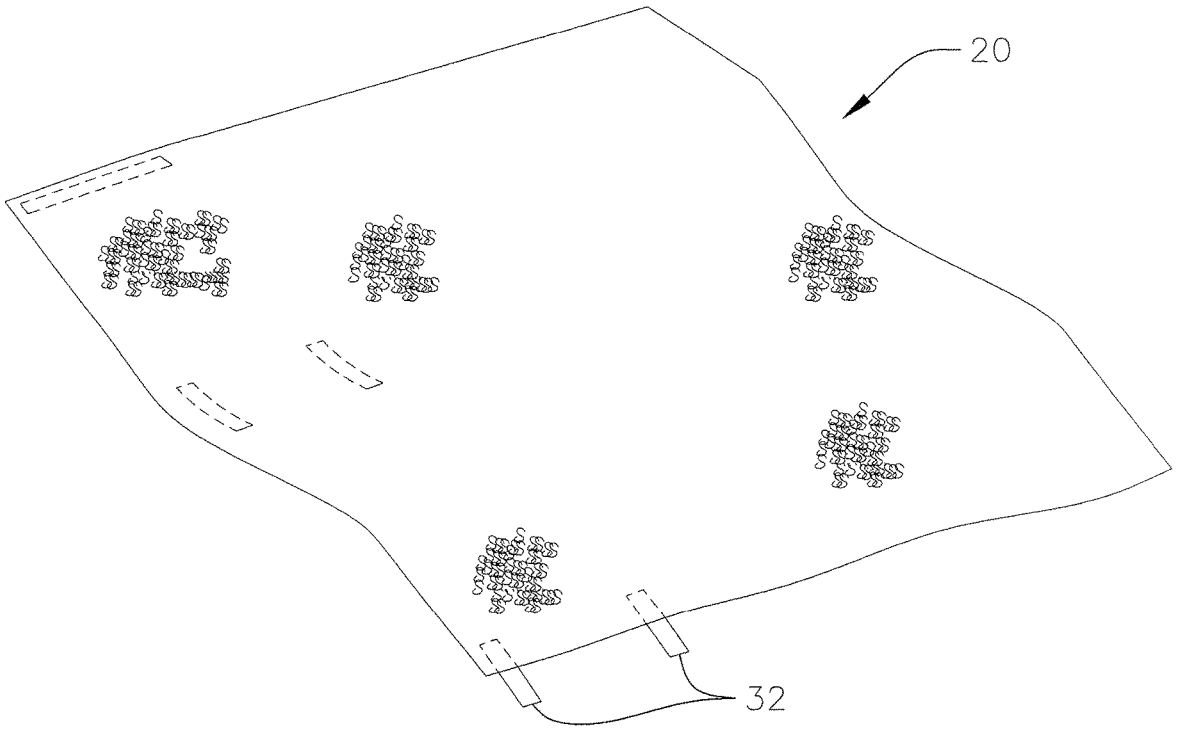
FIG. 4 is a top perspective view of a fire extinguishing blanket portion of the device of FIG. 1.
Figure 5:
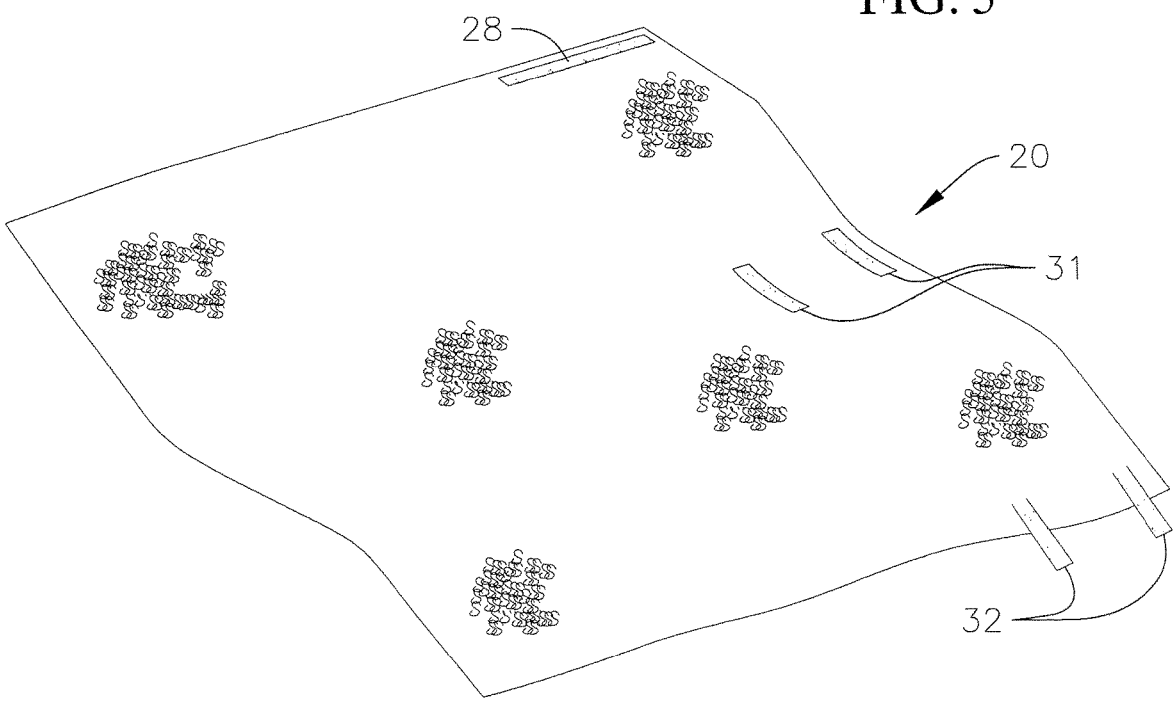
FIG. 5 is a bottom perspective view of the fire extinguishing blanket portion shown in FIG. 4.
Figure 6:
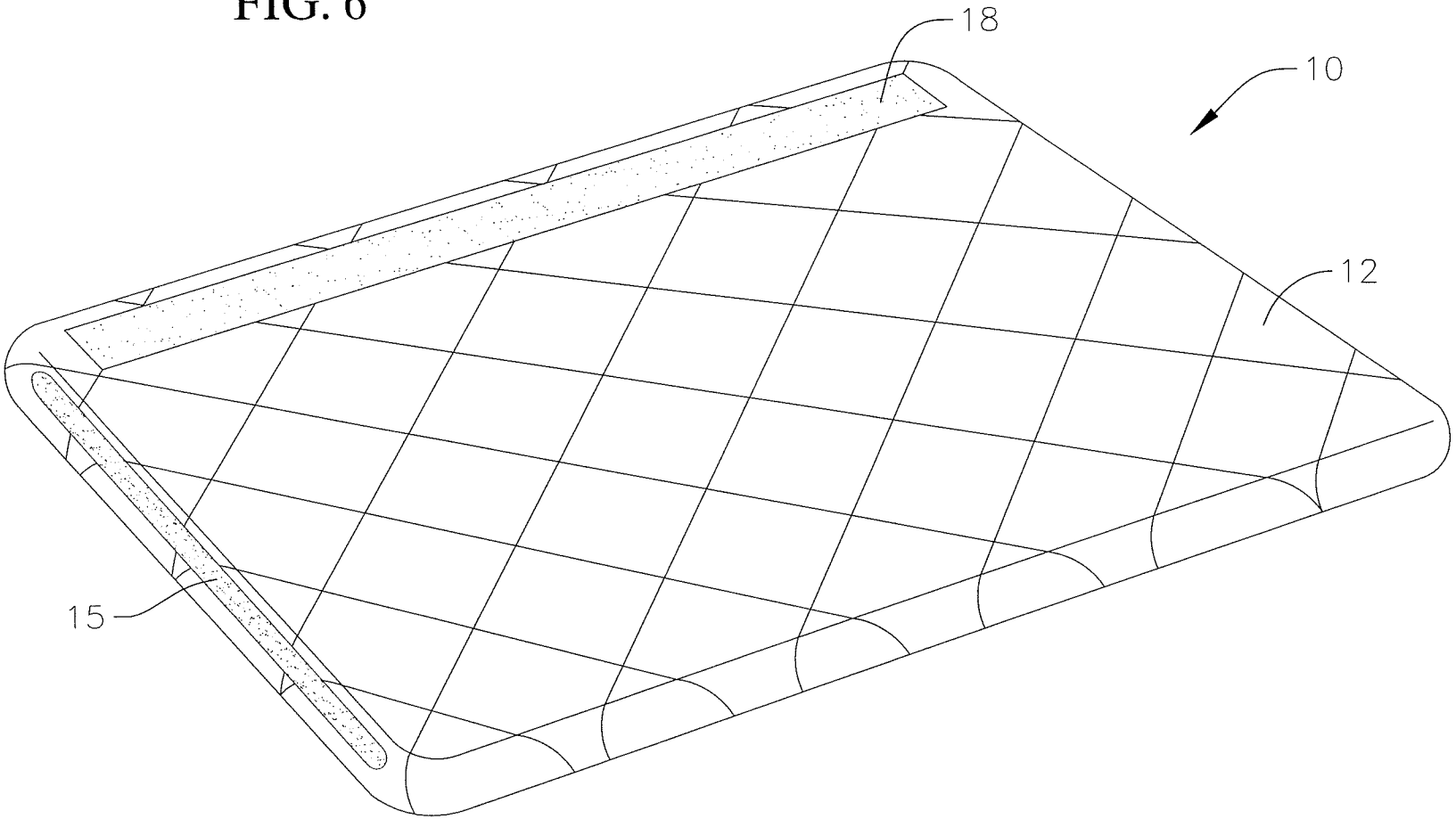
FIG. 6 is a perspective view of a mitt portion of the device of FIG. 1.

With reference to FIGS. 3 to 5, the blanket portion 20 is configured to extinguish a fire, such as a small or medium-sized kitchen fire, by smothering. That is, in an embodiment, the blanket portion 20 is configured to suffocate a fire by taking away oxygen, and not by using application of chemicals. In an embodiment, the blanket portion 20 is made of a fire-resistant material and, in one embodiment, is made of wool and/or other suitable materials that are fire and/or heat resistant for use in a fire blanket, such as materials that are compliant with ASTM F1989-05, titled "Standard Specification for Cooking Fire Suppression Blankets," for example. In one embodiment, the blanket portion 20, in the opened configuration, has a length of about 36 inches and a width of about 36 inches. In another embodiment, the blanket portion 20, in the opened configuration, has a length of about 24 inches and a width of about 24 inches. Further, in an embodiment, the blanket portion 20 may be flexible and have a thickness suitable for folding and/or wrapping the blanket portion 20 compactly around the mitt portion 10. However, the present invention is not limited thereto and, in other embodiments, the blanket portion 20 may have any other suitable size. According to an embodiment, the blanket portion 20 is in accordance with ASTM F1989-05, titled "Standard Specification for Cooking Fire Suppression Blankets."

Figure 2:
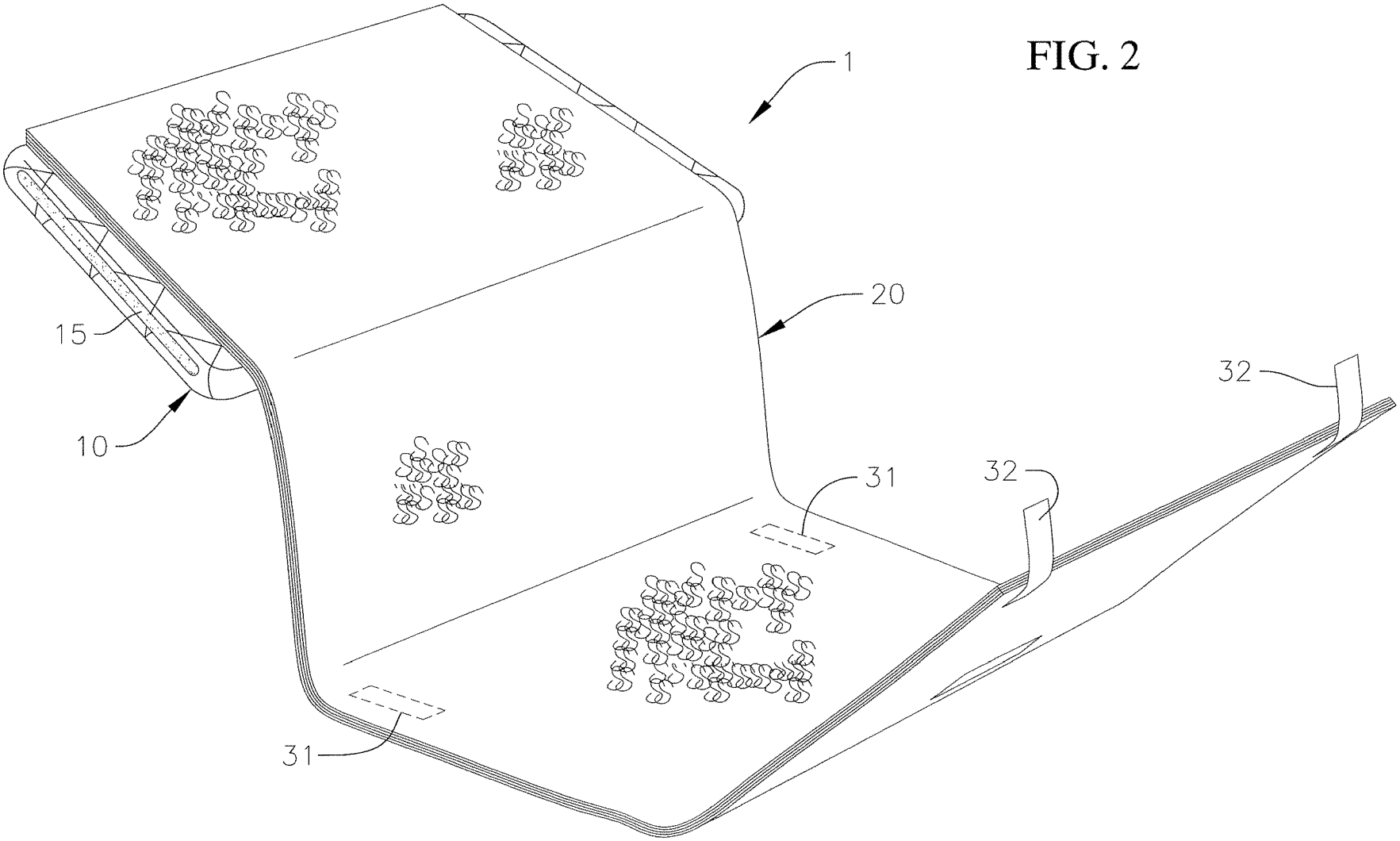
FIG. 2 is a perspective view of the device of FIG. 1, shown in a partially opened state.

With reference to FIGS. 1 to 3, the blanket portion 20 is at least one of foldable or wrappable around the mitt portion 10 to be in the first configuration. That is, in FIG. 1, the device 1 is shown with the blanket portion 20 folded and wrapped around the mitt portion 10 to be in the closed configuration. As further illustrated in FIGS. 2 and 3, the blanket portion 20 may be folded one or more times along a first direction, and may be folded and/or wrapped one or more times around the outer surface portion 12 of the mitt portion 10 to at least partially cover the outer surface 12 of the mitt portion. In embodiments of the present invention, the manner of folding and/or wrapping of the blanket portion 20 is not limited to that shown in FIGS. 1 to 3. Additionally, while in one embodiment, the blanket portion 20 may not be completely wrapped around the mitt portion 10, as depicted in FIG. 7, in one or more other embodiments, the blanket portion 20 may surround the mitt portion 10 and may be wrapped a plurality of times around a periphery of the mitt portion 10.

Further, in one embodiment, the blanket portion 20 may be removably attached to the mitt portion 10. In one embodiment, for example, the mitt portion 10 may be provided with a first hook-and-loop type fastener portion 18, and the blanket portion 20 may be provided with a second hook-and-loop type fastener portion 28 by which the blanket portion 20 may be removably attached to the mitt portion 10. However, the present invention is not limited thereto and, in other embodiments, the blanket portion 20 may be removably attached to the mitt portion 10 by any other suitable device. Furthermore, in one embodiment, the blanket portion 20 may be integrally attached to the mitt portion 10, as described further later herein.

According to an embodiment, the device 1 further includes a maintaining device 30 configured to maintain the blanket portion 20 in the second configuration, as shown in FIGS. 1 and 7. In one embodiment, the maintaining device 30 includes a hook-and-loop type fastener. That is, the maintaining device 30 may include a first hook-and-loop type fastener portion 31 on a portion of the blanket portion 20 and a second hook-and-loop type fastener portion 32 on another portion (e.g., an end portion) of the blanket portion 20, such that when the blanket portion 20 is in the closed configuration, the second hook-and-loop type fastener portion 32 engages the first hook-and-loop type fastener portion 31 to maintain the blanket portion 20 in the closed configuration. However, the present invention is not limited thereto and, in other embodiments, a maintaining device for maintaining the blanket portion 20 in the closed configuration may include any other suitable device, such as one or more ties, as described further later herein.

In an embodiment, as depicted in FIG. 1, the device 1 may further include fire safety tips 40 arranged on the blanket portion 20, such as printed on an outer surface of the blanket portion 20. The fire safety tips 40 are visibly arranged on the device 1 when the blanket portion 20 is in the closed configuration and when the blanket portion 20 is in the opened configuration. The fire safety tips 40 may include information regarding how large of a fire can be extinguished by the device, how to use a conventional fire extinguisher, how to put out a grease fire, and what to do when a fire is too large to put out, such as stopping, dropping, crawling under the smoke, calling for help, and remembering the exits. As such, the device 1 may function as an informational safety tool. In one embodiment, the device 1 may be colored red, such that a user may easily distinguish the device 1 from conventional oven mitts or pot holders, which may be in close proximity to the device 1.

Figure 8:
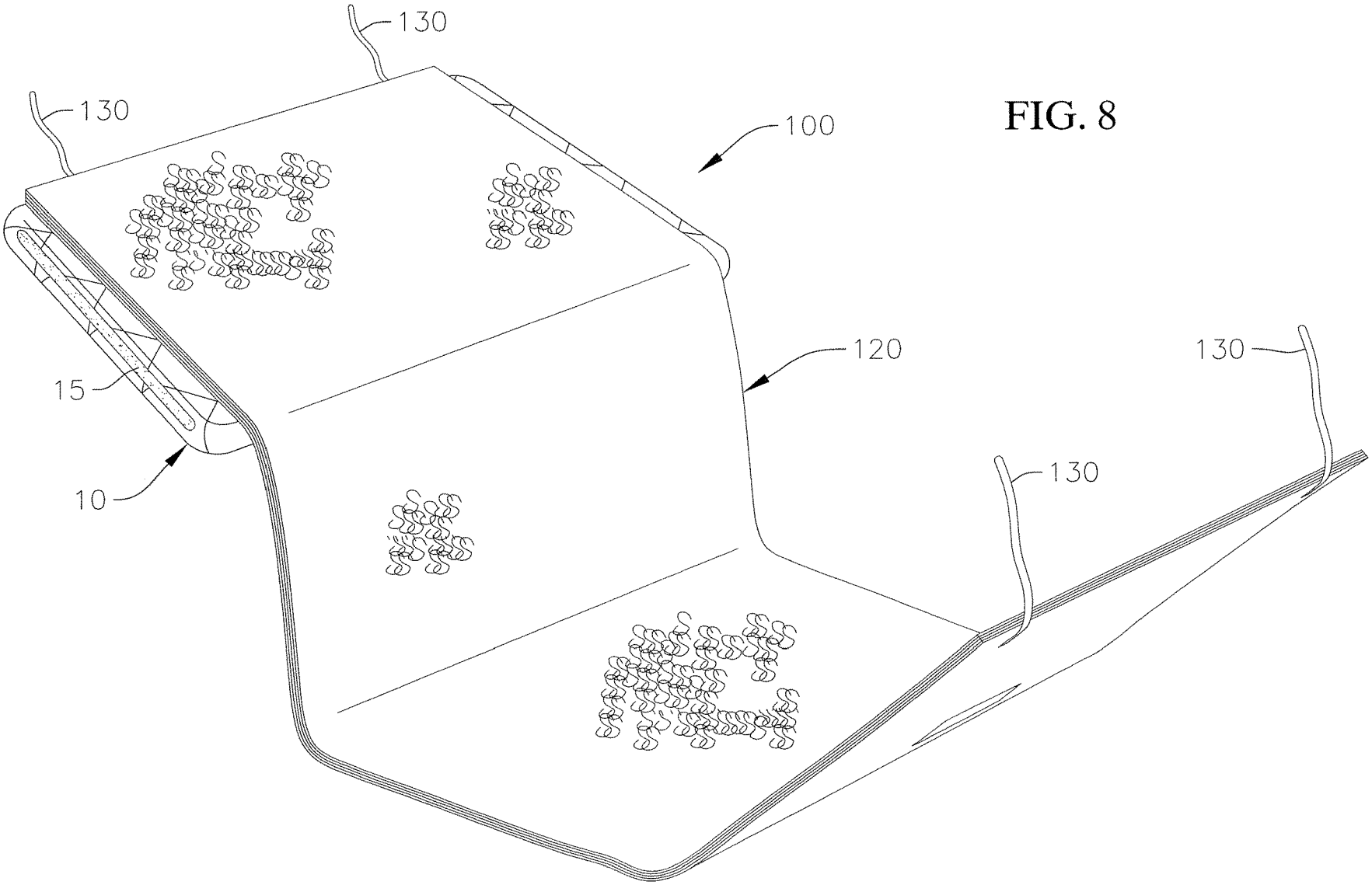
FIG. 8 is a perspective view of a device for handling hot objects and extinguishing a fire, according to another embodiment of the present invention, shown in a partially opened state.

With reference to FIG. 8, a device 100 for handling hot objects and extinguishing a fire, according to another embodiment of the present invention, is configured as an oven mitt and/or pot holder with integrated fire extinguishing blanket similar to the device 1 described above with reference to FIGS. 1 to 7. The device 100 differs from the device 1 in that a maintaining device to maintain a second portion, or blanket portion, 120 of the device 100 in the closed configuration includes one or more ties 130, or straps. The ties 130 may extend from portions (e.g., end portions) of the blanket portion 120 and may be tied to maintain the blanket portion 120 in the closed configuration. Alternatively, one or more of the ties 130 may extend from a portion of the mitt portion 10. The ties 130 are configured to be quickly and easily untied or removed to reconfigure the blanket portion 120 to be in the opened configuration, and may be further configured to be held by a user as handles to place the blanket portion 120 over a fire. In another embodiment, the device may include handles, such as handles that are compliant with ASTM F1989-05, titled "Standard Specification for Cooking Fire Suppression Blankets," for example, in addition to or instead of the ties 130 described above. Also, in an embodiment, the ties 130 and/or handles may have a different color than other portions of the device.

Figure 9:
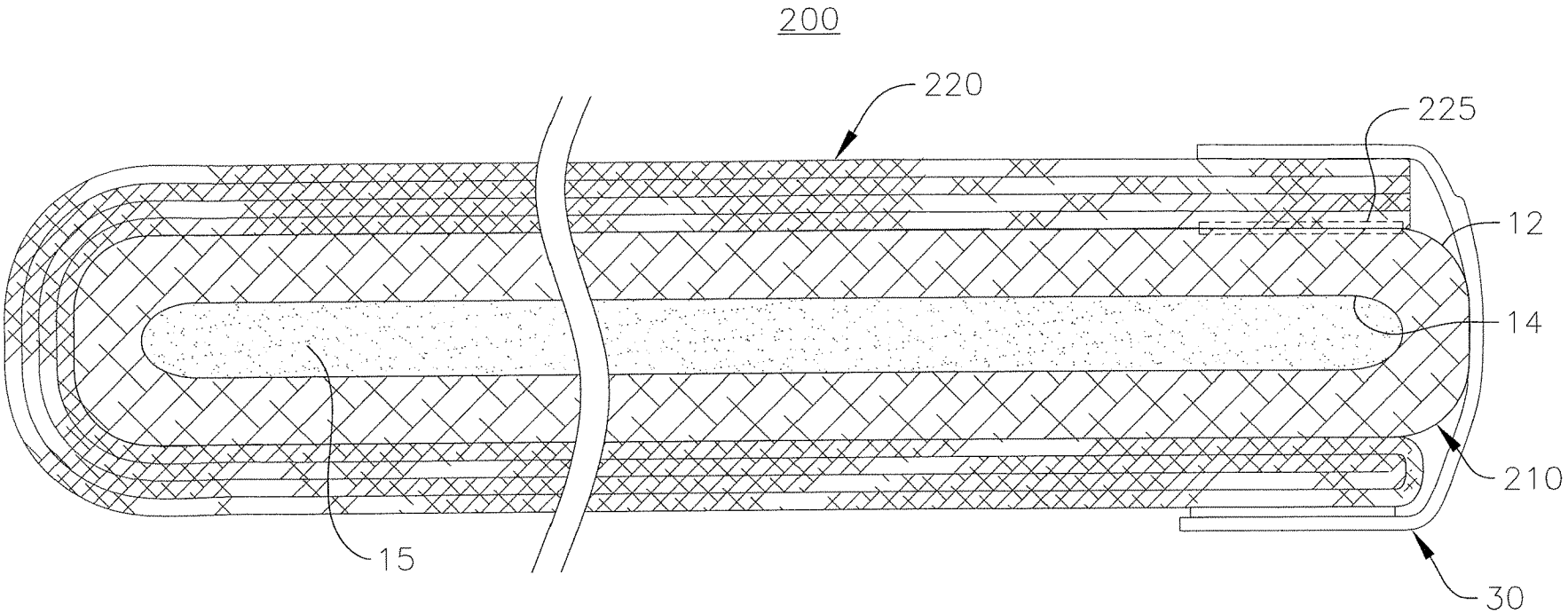
FIG. 9 is a cross-sectional view of a device for handling hot objects and extinguishing a fire, according to another embodiment of the present invention.
Figure 10:
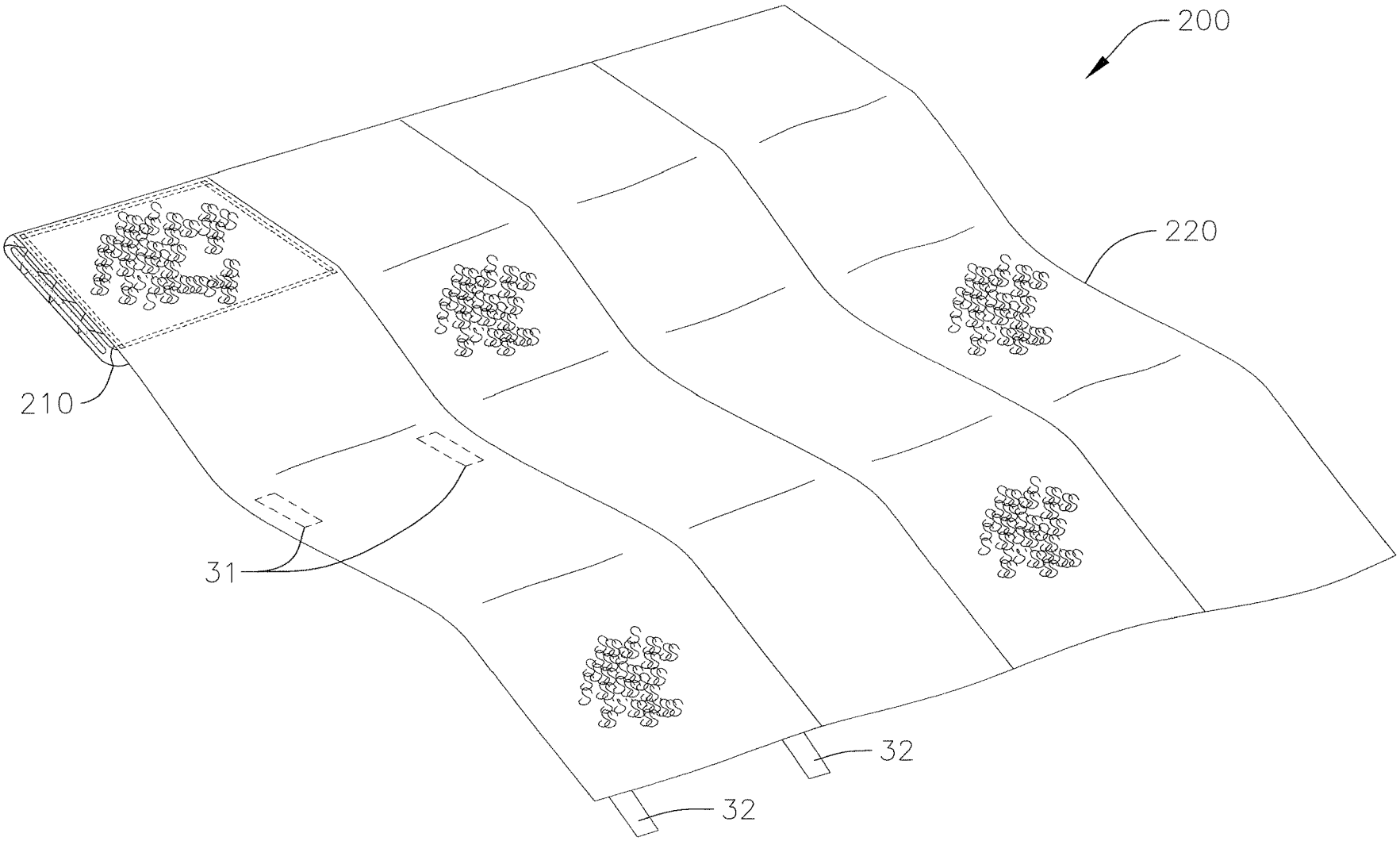
FIG. 10 is a perspective view of the device of FIG. 9, shown in an opened configuration.

With reference to FIGS. 9 and 10, a device 200 for handling hot objects and extinguishing a fire, according to another embodiment of the present invention, is configured as an oven mitt and/or pot holder with integrated fire extinguishing blanket similar to the device 1 described above with reference to FIGS. 1 to 7. The device 200 differs from the device 1 in that a second portion, or blanket portion, 220 of the device 200 is integrally attached to a first portion, or mitt portion, 210 of the device 200. In one embodiment, the blanket portion 220 may be integrally attached to the mitt portion 210 by stitching 225. However, the present invention is not limited thereto and, in other embodiments, the blanket portion 220 may be integrally attached to the mitt portion 210 by any other suitable device or method, and, in one embodiment, the blanket portion 220 may extend from the mitt portion 210 monolithically or as a single piece of material. As shown in FIG. 10, the blanket portion 220 may be unfolded and/or unwrapped from the mitt portion 210 to be in the opened configuration.

Figure 11:
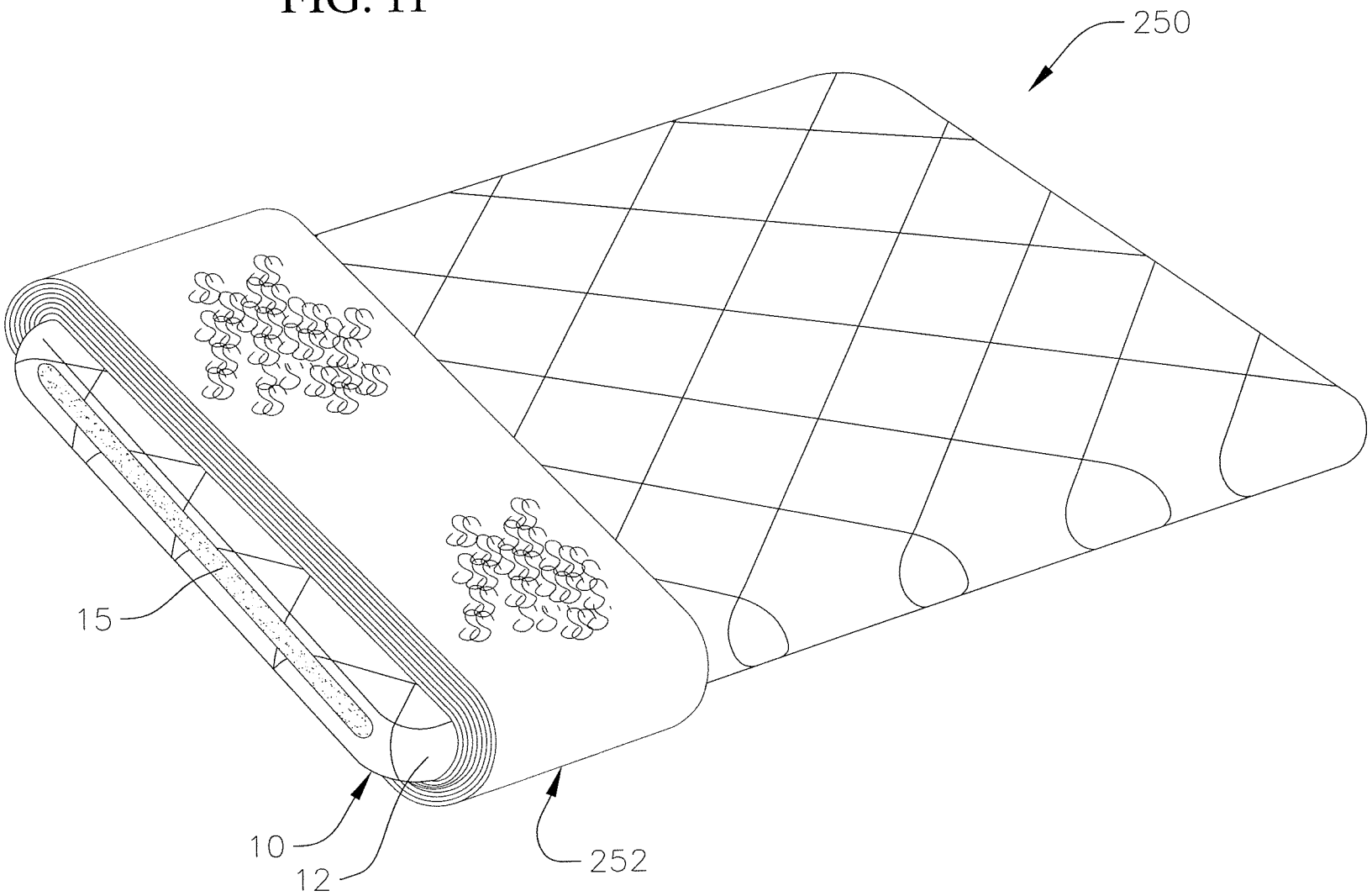
FIG. 11 is a perspective view of a device for handling hot objects and extinguishing a fire, according to another embodiment of the present invention.

With reference to FIG. 11, a device 250 for handling hot objects and extinguishing a fire, according to another embodiment of the present invention, is configured as an oven mitt and/or pot holder with integrated fire extinguishing blanket similar to the device 1 described above with reference to FIGS. 1 to 7. The device 250 differs from the device 1 in that a blanket portion 252 of the device 250 is configured to be wrapped one or more times around the mitt portion 10 to be in the closed configuration. The blanket portion 252 may be folded one or more times before being wrapped so as to be compact and cover the mitt portion 10 at an end of the mitt portion 10 having an opening to the pocket 15 (e.g., a wrist portion). The device 250 may further include a maintaining device, such as one of the maintaining devices described above, configured to maintain the blanket portion 252 in the closed configuration until a user wishes to open the blanket portion 252.

Figure 12:
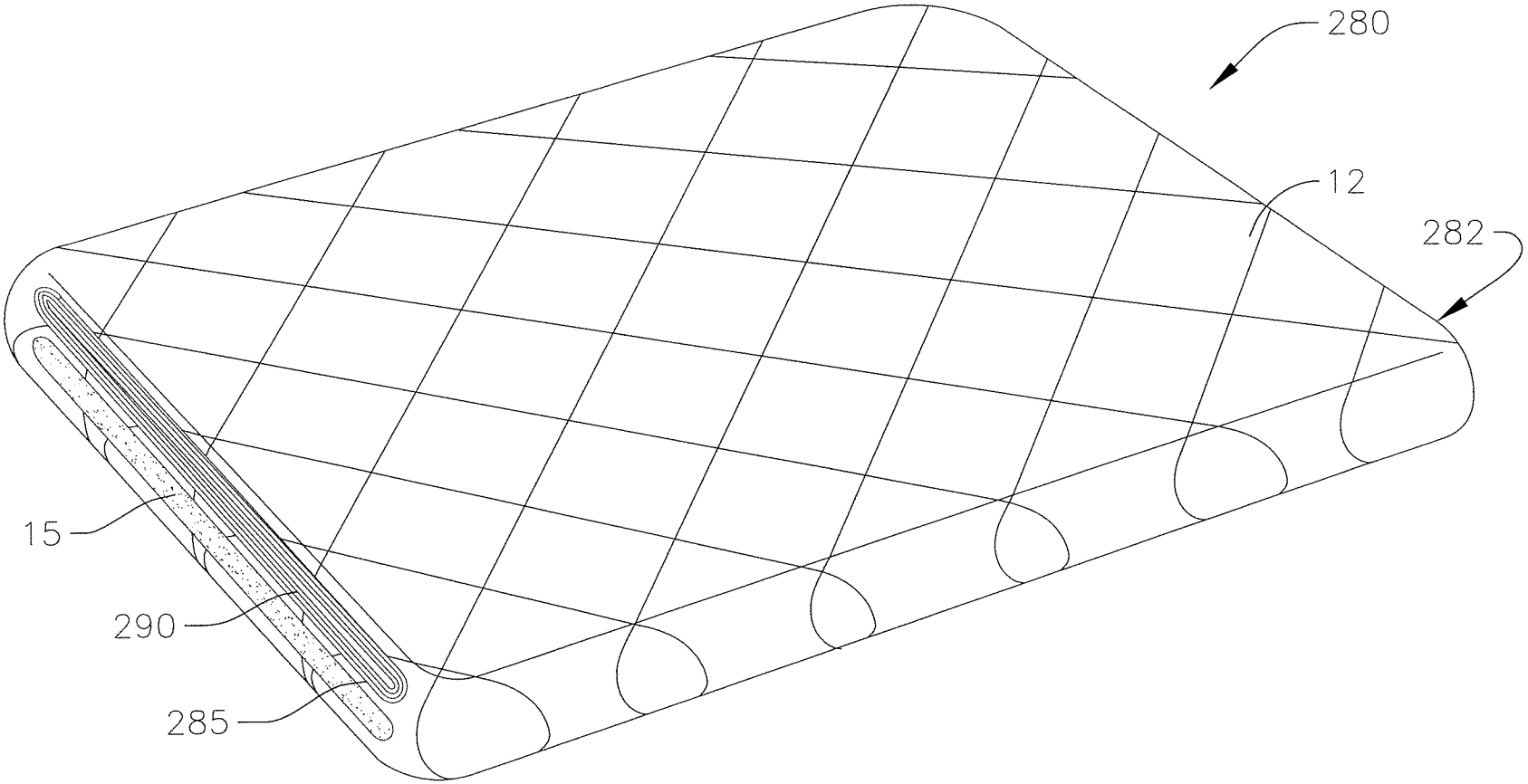
FIG. 12 is a perspective view of a device for handling hot objects and extinguishing a fire, according to another embodiment of the present invention.

With reference to FIG. 12, a device 280 for handling hot objects and extinguishing a fire, according to another embodiment of the present invention, is configured as an oven mitt and/or pot holder with integrated fire extinguishing blanket similar to the device 1 described above with reference to FIGS. 1 to 7. The device 280 differs from the device 1 in that a mitt portion 282 of the device 280 includes another pocket 285 configured to receive a blanket portion 290 of the device 280 therein in the closed configuration. In an embodiment, the pocket 285 has an opening to receive the blanket portion 290 at a same end of the mitt portion 282 at which the pocket 15 has an opening. In one embodiment, the blanket portion 290 may be folded and stored in the pocket 285 in the closed configuration until a user wishes to open the blanket portion 290. In one embodiment, the blanket portion 290 may be integrally attached (e.g., stitched) in the pocket 285. However, in other embodiments, the blanket portion 290 may be removably attached to the mitt portion 282, or may not be attached to the mitt portion 282 but, rather, merely folded and inserted into the pocket 285. In one embodiment, the device 280 may further include a maintaining device, such as one of the maintaining devices described above, configured to maintain the blanket portion 290 in the closed configuration and/or inside the pocket 285 until a user wishes to open the blanket portion 290. A method of using the device 280 may include a task of removing the blanket portion 290 from the pocket 285, such as to smother a fire with the blanket portion 290.

Figure 13:
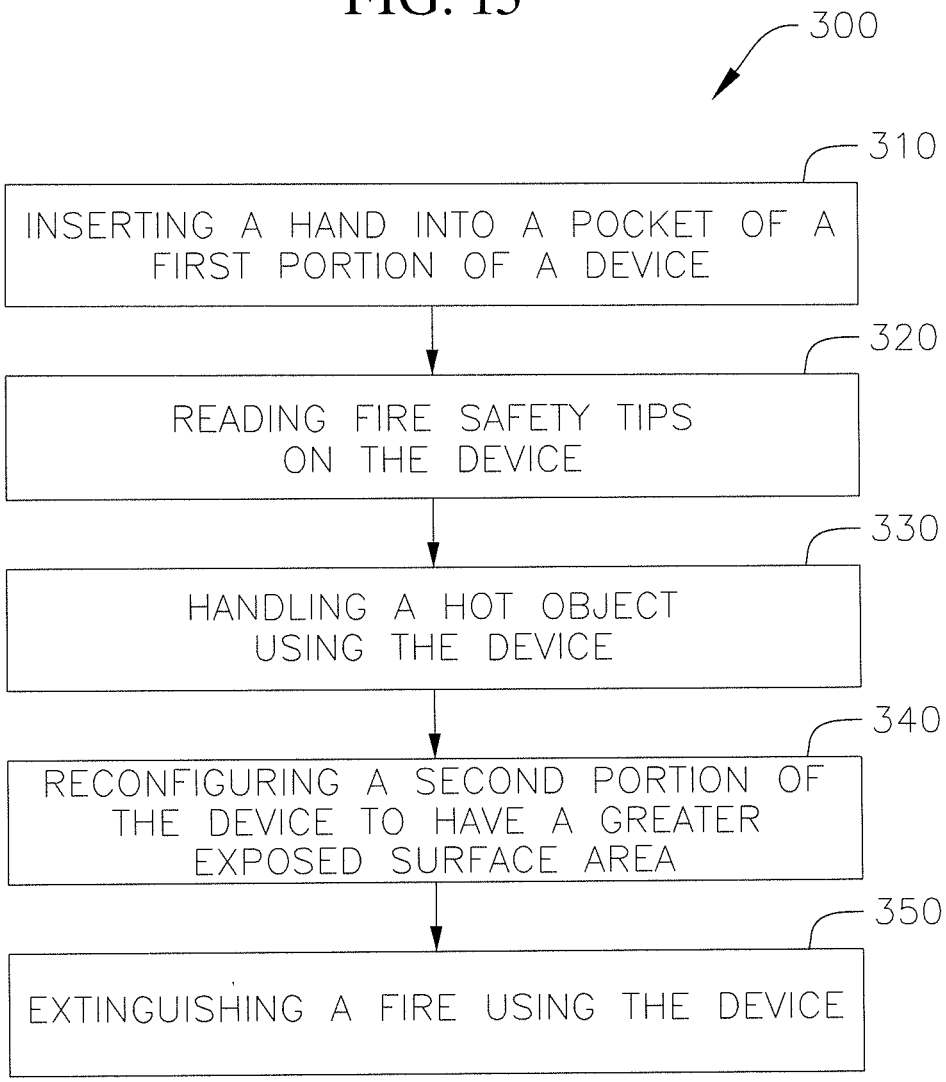
FIG. 13 is a flowchart showing tasks of a method of using a device for handling hot objects and extinguishing a fire, according to an embodiment of the present invention.

With reference to FIG. 13, a method 300 of using a device for handling hot objects and extinguishing a fire according to an embodiment of the present invention is shown. The method 300, in one embodiment, may be performed in using, and is described below with reference to, the device 1 described above and shown in FIGS. 1 to 7. However, in other embodiments, the method 300, or at least some of the tasks thereof, may be performed in using a device for handling hot objects and extinguishing a fire according to other embodiments of the present invention, such as the devices 100, 200, 250, and 280 described above and shown in FIGS. 8 to 12.

According to an embodiment, the method 300 includes a task 310 of inserting a hand into the pocket 15 of the mitt portion 10 of the device 1. That is, in an embodiment, the device 1 is configured as an oven mitt and/or pot holder which a user may easily wear over a hand to protect the hand when handling hot objects.

In an embodiment, the method 300 further includes a task 320 of reading the fire safety tips 40 arranged (e.g., printed) on the device. As described above, the fire safety tips 40 may include information regarding how large of a fire can be extinguished by the device, how to use a conventional fire extinguisher, how to put out a grease fire, and what to do when a fire is too large to put out, such as stopping, dropping, crawling under the smoke, calling for help, and remembering the exits.

According to an embodiment, the method 300 includes a task 330 of handling a hot object using the device 1. The device 1, in one embodiment, is configured as an oven mitt and/or pot holder and may be used to handle a hot object, such as a kitchen pot, for example, with the blanket portion 20 in the closed configuration.

In an embodiment, the method 300 further includes a task 340 of reconfiguring the blanket portion 20 to have a greater surface area. That is, the blanket portion 20 may be reconfigured from the closed configuration to the opened configuration to have a greater exposed surface area, such as by unwrapping and/or unfolding the blanket portion 20 from the mitt portion 10.

According to an embodiment, the method 300 further includes a task 350 of extinguishing a fire using the device 1. The device 1 may be used to extinguish a fire, such as a kitchen fire, with the blanket portion 20 in the opened configuration. The device 1 may be used to extinguish a fire by smothering without application of chemicals.

While, in one embodiment, the method 300 of using a device for handling hot objects and extinguishing a fire may include each of the tasks described above and shown in FIG. 13, in other embodiments of the present invention, in a method of using a device for handling hot objects and extinguishing a fire, one or more of the tasks described above and shown in FIG. 13 may be absent and/or additional tasks may be performed. Further, in the method 300 of using a device for handling hot objects and extinguishing a fire according to one embodiment, the tasks may be performed in the order depicted in FIG. 13. However, the present invention is not limited thereto and, in a method of using a device for handling hot objects and extinguishing a fire according to other embodiments of the present invention, the tasks described above and shown in FIG. 13 may be performed in any other suitable sequence.

Although the drawings illustrate the invention as applied to an oven mitt with integrated fire extinguishing blanket, it will be apparent that the novel aspects of the automated system and method of the invention may also be applied to other applications. For example, aspects of embodiments of a device for handling hot objects and extinguishing a fire and a method of using the same as described herein may be applied to a device used in a laboratory, a recreational vehicle, an automotive garage, etc. Further, it will be apparent to those skilled in the art that a device for handling hot objects and extinguishing a fire and a method of using the same may incorporate or embody various combinations of the embodiments described above with respect to the shapes, sizes, components, and configurations of the device, as well as alternatives not described herein, without departing from the spirit and scope of the present invention.

The preceding description has been presented with reference to some exemplary embodiments of the invention. Persons skilled in the art and technology to which this invention pertains will appreciate that alterations and changes in the described structures and methods of assembly and operation can be practiced without meaningfully departing from the principles, spirit, and scope of this invention.

What is claimed is:

1. A method of using a device for handling hot objects and including a first portion defining a pocket, and a second portion made of a fire-resistant material, the second portion being configurable between a first configuration in which the second portion at least partially covers the first portion and has a first exposed surface area and a second configuration in which the second portion has a second exposed surface area greater than the first exposed surface area, wherein the second portion, in the second configuration, has a length greater than a greatest length of the first portion and a width greater than a greatest width of the first portion, the method comprising:

inserting a hand into the pocket of the first portion;

handling a hot object using the device, while the second portion is in the first configuration; and reconfiguring the second portion from the first configuration to the second configuration.

2. The method of claim 1, wherein reconfiguring the second portion from the first configuration to the second configuration comprises at least one of unwrapping the second portion from an outside of the first portion or unfolding the second portion.

3. The method of claim 1, further comprising extinguishing a fire by covering the fire with the second portion, the second portion being in the second configuration.

4. The method of claim 1, wherein the first portion further defines another pocket, and the method further comprises removing the second portion from the another pocket.

5. The method of claim 1, further comprising reading fire safety information located on the device.

* * * * *